United States Patent [19]

DePenti

[11] 4,203,523

[45] May 20, 1980

[54] LOCKSETTING MECHANISM FOR A RIGID JAW COUPLER

[75] Inventor: Kenneth L. DePenti, Mayfield Heights, Ohio

[73] Assignee: Midland-Ross Corporation, Cleveland, Ohio

[21] Appl. No.: 916,475

[22] Filed: Jun. 19, 1978

[51] Int. Cl.[2] ..... B61G 3/12

[52] U.S. Cl. ..... 213/100 W; 213/75 B; 213/77

[58] Field of Search ..... 213/100 R, 100 W, 75 B, 213/77

[56] References Cited

U.S. PATENT DOCUMENTS

| | | | |
|---|---|---|---|
| 2,591,275 | 4/1952 | Metzger | 213/100 W |
| 2,940,610 | 6/1960 | Metzger | 213/100 W |
| 2,951,597 | 9/1960 | Metzger | 213/100 W |

*Primary Examiner*—Randolph A. Reese

*Attorney, Agent, or Firm*—Harlan E. Hummer

[57] ABSTRACT

A rigid jaw-type coupler having a locksetting mechanism which can be easily tripped to restore the lock from a lockset position back to a locked position. The mechanism comprises a lock operating lever which is provided with a projecting lug that is designed to slidably engage and override a specially contoured cam which is carried by a pawl for holding the lever and lock in a lockset position.

12 Claims, 6 Drawing Figures

LOCKSETTING MECHANISM FOR A RIGID JAW COUPLER

BACKGROUND OF THE INVENTION

The invention is an improvement in a rigid jaw car coupler which is manufactured and sold by the Foundry Group of the Midland-Ross Corporation of Cleveland, Ohio, under the trademark Willison. This coupler is primarily used on mine cars and other similar industrial applications. Rigid jaw couplers of this type utilize a locklifting lever which extends exteriorly of the coupler for operating the locking mechanism to cause disengagement of a pair of interlocked couplers. It is necessary for an operator to go between a pair of coupled mine cars to operate the lever of most couplers in use today.

U.S. Pat. No. 2,951,597 is directed to a locking mechanism for placing the lock of a rigid jaw coupler in a lockset position to permit disengagement of a pair of interlocked couplers. This is accomplished by the use of a specially designed pawl which extends exteriorly of the coupler and holds the locklifting lever and lock in a lockset position until the locked couplers are separated. The disadvantage of this locking mechanism is that, should an operator change his mind about separating the couplers and decide to return the lock and lever to their locked positions, he must step between the coupled cars, grasp the exposed handle of the pawl and lift it to cause disengagement of the locklifting lever from the pawl, so that the lock and locklifting lever can move back to their normal locked positions. Any such operation demanding the presence of the operator between a pair of coupled cars is hazardous to the safety of the operator. The invention is directed to solving this problem by providing a locking mechanism which can return the lock to its normal locked position from a lockset position by an operator standing alongside the cars rather than between them.

Briefly stated, the invention is in a rigid jaw coupler employing a spring biased lock, a locklifting lever for moving the lock between its locked and lockset positions, and a lockset member or pawl for engaging the locklifting lever and holding it and the lock in a lockset position. The locklifting lever is provided with a lug which is designed to slidably engage and become interlocked with a cam that is carried by the pawl to hold the locklifting lever in its position. The contour of the cam is such that the interlocked lug can override the cam when the lever is returned to its normal rest position where the locking mechanism is in a locked position. It is not necessary to manually operate the pawl. It is only necessary to operate the locklifting lever which is usually accomplished through linkage that is coupled to the lever and extends to the side of the car employing the couplers. Thus, it is unnecessary for an operator to go between a pair of coupled cars and this hazard has been eliminated at least in connection with the operation of the couplers.

DESCRIPTION OF THE DRAWINGS

The following description of the invention will be better understood by having reference to the accompanying drawing, wherein.

ENVIRONMENT OF THE INVENTION

Figure 1:
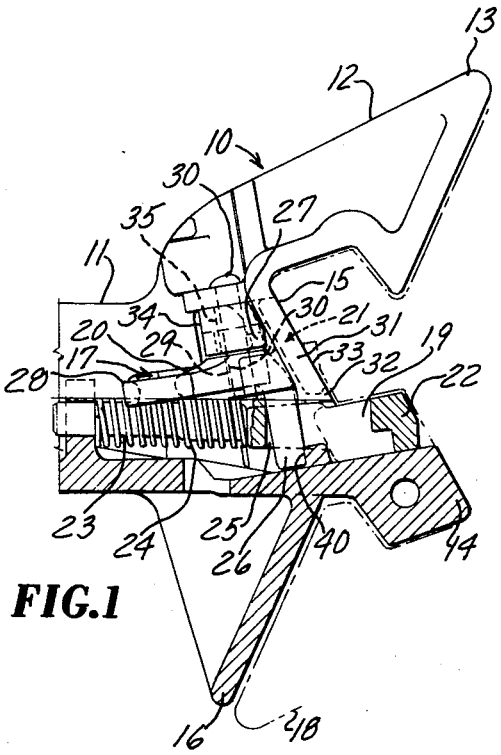
FIG. 1 is a plan view of a portion of an interlocked rigid jaw coupler which is made in accordance with the invention and is shown, in section, to illustrate the locking mechanism in a normally locked position.

Referring generally to the drawing and more particularly to FIG. 1, there is shown a rigid jaw coupler 10 comprising a shank 11, chambered head 12 having a pair of laterally spaced rigid jaws 13, 14 which are connected by a buffing face 15, a guard arm 16 that extends laterally beyond the adjacent rigid jaw 14, and a locking mechanism 17 which is disposed within the chambered head 12 of the coupler 10. The coupler 10 is designed to matingly engage and interlock with an opposing rigid jaw coupler 18, shown in dotted line.

THE INVENTION

Figure 2:
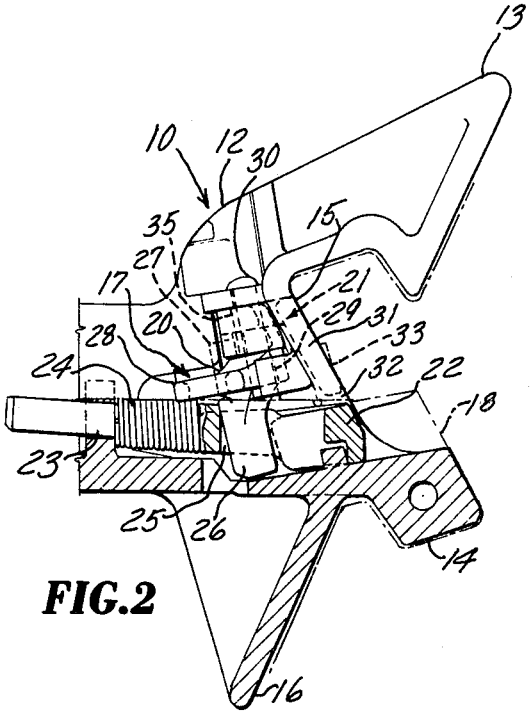
FIG. 2 is a similar plan view of the coupler portion which is also shown, in section, to illustrate the locking mechanism in lockset position.

The locking mechanism 17 essentially comprises a lock 19, a locklifting lever 20 for moving the lock 19 between the locked position of FIG. 1 and the lockset position of FIG. 2, and a lockset member or pawl 21 for restricting movement of the lever 20 when the lock 19 is in the lockset position.

Figure 3:
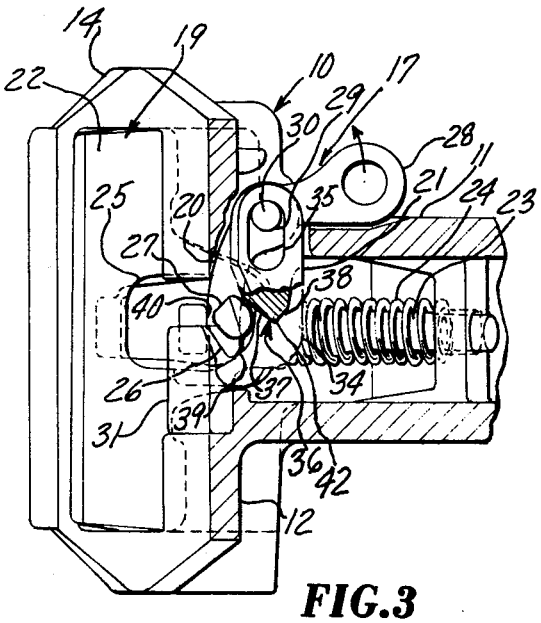
FIG. 3 is a side view of the coupler portion which is shown, in section, to illustrate the locking mechanism in a normally locked position.
Figure 4:
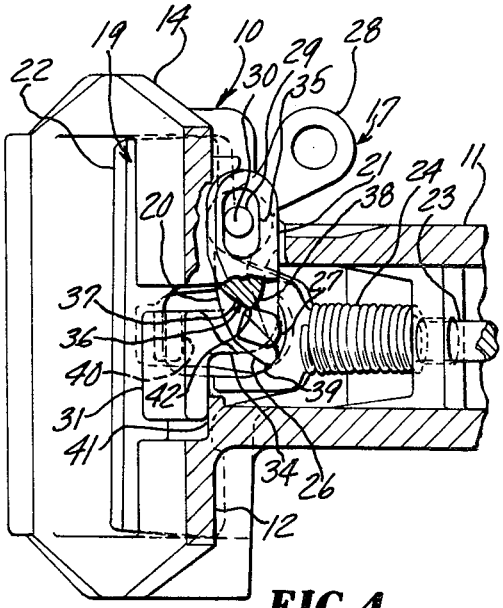
FIg. 4 is a similar side view of the coupler portion which is also shown, in section, to illustrate the locking mechanism intermediate the locked and lockset positions.
Figure 5:
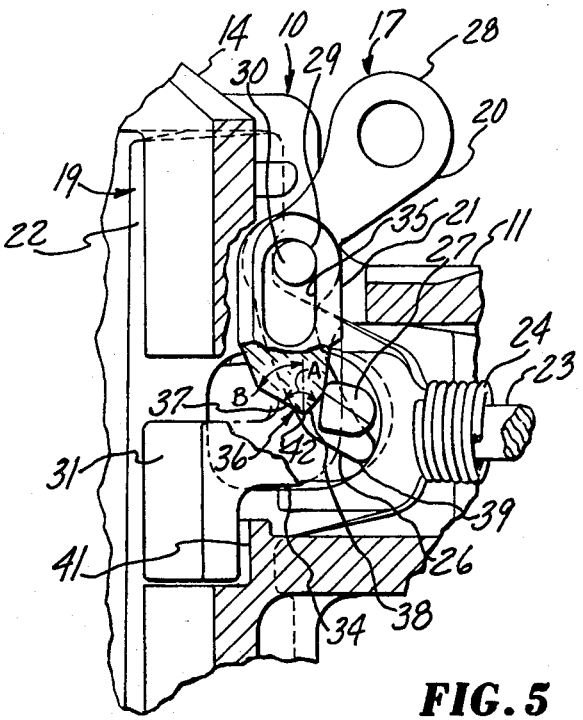
FIG. 5 is a similar side view of the coupler portion which is also shown, in section, to illustrate the locking mechanism in a lockset position.
Figure 6:
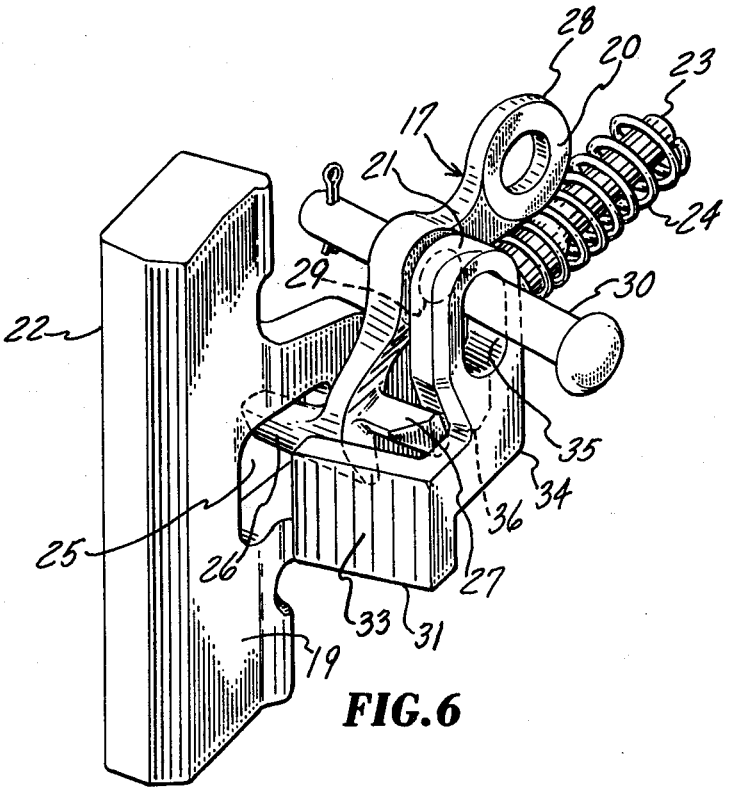
FIG. 6 is a perspective view of the locking mechanism.

The lock 19, when the coupler 10 is in a normally horizontal position, as shown in FIGS. 3-5, comprises a vertically elongated bar 22 with a rearwardly extending cylindrical tail 23 that is surrounded by a coil spring 24 which biases the lock bar 22 outwardly of the buffing face 15 adjacent the rigid jaw 14, where the lock 19 is in a locked position. The lock 19 is mounted within the chambered head 12 for axial movement longitudinal of the coupler 10. The lock 19 is provided with an elongated slot 25 which is horizontally disposed rearwardly of the lock bar 22 and designed to receive a rocker arm 26 that extends laterally from the locklifting lever 20.

A lug 27 extends from the plane of the lever 21 in a direction opposite the rocker arm 26. The lever 20 includes a handle 28 which extends exteriorly of the coupler head 12 and to which any suitable linkage can be connected and carried adjacent the sidewall of, for example, a mine car utilizing the particular coupler, so that an operator can manipulate the locking mechanism 17 while standing alongside the mine car, without necessitating going between a pair of coupled cars, which action can be hazardous to the safety of the operator. The rocker arm 26 and lug 27 are secured to the end of the lever 20 opposite the handle 28. The lever 20 is provided with a circular opening 29 that extends laterally through the lever 20 intermediate its opposing ends or the rocker arm 26 and handle 28, for receiving a pivot pin 30 which is carried by the coupler head 12 and to which the lever 20 is rotatably mounted.

The lockset member or pawl 21 has a transversely extending plate 31 which is disposed in an opening 32 in the buffing face 15 of the coupler 10. The plate 31 has a front face 33 which is generally flush with the buffing face 15 when the lock 19 is in the locked position of FIG. 1. The pawl 21 has a generally L-shaped body portion 34 which extends from the front plate 31 and which is provided with a vertically elongated slot 35 through which the pivot pin 30 of the coupler head 12 passes. Thus, it can be appreciated that the pawl 21 is both rotatable about the pivot pin 30 and movable vertically lengthwise of the slot 35.

The pawl 21 is provided intermediate its opposing ends with a projecting cam 36 which is specially contoured for sliding engagement with the lug 27 that extends from the lever 20. The cam 36 is V-shaped, being formed of a pair of intersecting camming surfaces 37,38 along which the lug 27 slides, as it moves into and out of interlocking engagement with the cam 36. The front surface 37 of the cam 36 faces and is closest the buffing face 15 of the coupler 10, whereas the rear surface 38 faces away from the buffing face 15. The intersecting, camming surfaces 37, 38 diverge in the direction of the pivot pin 30 which is disposed vertically above the cam 36. The included angle A (FIG. 5) between the front and rear camming surfaces 37,38, is in the range of from 85°-90° for the best results, and the angle B between the front face 37 and the longitudinal axis of the generally vertical slot 35 is greater than 45° and less than 90° and is in the range of from 50°-55° for best results. The camming surfaces 37,38 are angled or sloped so as to restrict movement of the lug 27 when interlocked with the cam 36, yet permit the interlocking lug 27 to override the cam 36 when the handle 28 is rotated back to its normal rest position adjacent to the coupler shank 11.

OPERATION OF THE LOCKING MECHANISM

For the purpose of this discussion, it will be assumed that the lock 19 is biased in the locked position of FIGS. 1 and 3, where the handle 28 of the locklifting lever 20 is generally horizontal adjacent the coupler shank 11, and the rocker arm 26, carried by the opposing free end 39 of the lever 20, is engaged between the spring biased lock 19 and adjacent stop 40 which is formed in the coupler head 12 and designed to restrict forward movement of the lock 19 in a direction away from the coil spring 24. The pawl 22 is likewise restricted between the opposing coupler 18 and an abutment 41 that is formed in the chambered head 12 in spaced relation from the stop 40.

An operator, desiring to uncouple the pair of interlocked couplers 10, 18, actuates the linkage bars coupled to the handle 28 of the locklifting lever 20 to rotate the handle 28, as seen in FIGS. 3-5, in a counterclockwise direction about the fixed pivot pin 30. The rocker arm 26, carried by the locklifting lever 20, immediately acts against the lock 19 to move it rearwardly into more biased relation with the coil spring 24, as best seen in FIG. 4. Simultaneously, the lug 27 of the locklifting lever 20 slidingly engages the front surface 37 of the cam 36, causing the pawl 21 to move vertically, as best seen in FIG. 4. When the handle 28 of the lever 20 is rotated to its vertically foremost position, as seen in FIG. 5, the rocker arm 26 moves the lock 19 to its farthest rearward position or the lockset position. Simultaneously, the lug 27 of the lever 20 passes beyond the V-shaped cam 36 or juncture 42 of the intersecting camming surfaces 37,38 to a position where it is in contact with the vertically uppermost portion of the rear surface 38, which allows the pawl 21 to drop vertically back to its normal rest position, where the plate 31 is held between the abutment 41 and opposing coupler 18 which exerts a force against the pawl 21 sufficient to overcome the opposing force of the coil spring 24 tending to raise the pawl 21 vertically, so that the lug 27 can override the cam 36. The locking mechanism 17 is now in a lockset position where the opposing coupler 18 can be disengaged. Immediately upon disengagement of the couplers 10, 18, and the removal of the rearwardly directed force against the plate 31 of the pawl 21 by the opposing coupler 18, the coil spring 24 acts to move the lock 19 forwardly back to its locked position. The lug 27 now engages the cam 36 and holds the pawl 21 in substantially its rest position of FIG. 3.

In some instances, it is desirable to relock a pair of joined couplers, after the lock 19 has been moved to the lockset position. This is done by moving the handle 28 of the locklifting lever 20 in a clockwise direction from its most vertical position back to its normal rest position adjacent the coupler shank 11. The additional force exerted by the lug 27 against the cam 36 causes the pawl 21 to move upwardly, whereby the lug 27 can override the cam 36, as previously described, so that the coil spring 24 can return the lock 19 to its locked position. The angular disposition of the front and rear camming surfaces 37,38, relative to the movement of the lug 27 of the locklifting lever 19, and the biasing forces of the coil spring 24 and opposing coupler 18 upon the pawl 21, is important, since the lug 27 should not override the cam 36 too easily. Otherwise, the biasing force of the coil spring 24 would continually return the lock 19 to its locked position and it would be virtually impossible to maintain the lock 19 in its lockset position.

Thus, there has been provided a rigid jaw-type coupler having a highly improved locking mechanism wherein it is only necessary to operate the handle of the locklifting lever to successively move the lock from a locked position to a lockset position and then return the lock to a locked position. There is no need for an operator to go between a pair of coupled cars to manually operate the locking mechanism to relock a pair of couplers that have been previously unlocked for uncoupling.

What is claimed is:

1. A coupler having a shank extending from a chambered head with a buffing face that connects a pair of laterally spaced fixed jaws, and a locking mechanism which comprises:

(a) a spring biased lock disposed within the chambered head and movable generally longitudinally of the coupler shank between a locked position and a lockset position, the lock having an axially elongated slot therein;

(b) a locklifting lever for moving the lock between the locked and lockset positions, the lever having a pair of opposing ends;

(c) means mounting the lever on the coupler head for limited rotation about an axis which is normal to the longitudinal axis of the coupler shank;

(d) a handle at one of the opposing ends of the lever and disposed exteriorly of the coupler head for operating the lever;

(e) a lug and rocker arm disposed within the chambered head at the other of the opposing ends of the lever, the lug and arm extending in opposite directions from the plane of the lever, the arm being received in the slot of the lock and designed to move the lock axially against the biasing spring, when the handle of the lever is rotated in one direction to operate the lever;

(f) a pawl for frictionally engaging the lug and holding the lock in the lockset position, the pawl having a plate at one end thereof for receipt in an opening disposed in the buffing face of the coupler adjacent the lock, the pawl including a cam for slidably engaging the lug and interlocking coaction with the lug when the lock is moved by the lever to the lockset position, the cam being shaped so that the lug lifts and overrides the cam when the handle is rotated in a direction opposite said one direction, to allow the lock to return to the locked position from the lockset position; and (g) means mounting the pawl for limited movement in a direction which is generally normal to the axial direction in which the lock moves between the locked and lockset positions.

2. The coupler of claim 1, wherein the lever mounting means (c) includes a pivot pin secured to the chamber head, and a hole extending transversely through the lever intermediate opposing ends thereof for receipt of the pivot pin.

3. The coupler of claim 2, wherein the pawl mounting means (g) includes an elongated slot disposed in the pawl adjacent the end thereof opposite the plate, for receiving the pivot pin, and means for restricting movement of the plate to a direction which parallels the longitudinal axis of the elongated slot in the pawl.

4. The coupler of claim 3, wherein the cam is V-shaped, having a pair of intersecting camming surfaces which diverge in the direction of the pivot pin.

5. The coupler of claim 4, wherein the cam is disposed between the elongated slot and plate of the pawl.

6. The coupler of claim 5, wherein the camming surfaces are of such a length and angled relative to the longitudinal axis of the elongated slot of the pawl, such that the lug carried by the lever will slidably engage the camming surfaces.

7. The coupler of claim 6, wherein the plate restricting means includes a pair of spaced abutments disposed within the chambered head, the abutment closest the buffing face of the coupler head being positioned to engage the end of the lever adjacent the lug and rocker arm.

8. The coupler of claim 7, wherein the angle (B) between the longitudinal axis of the elongated slot of the pawl and the camming surface of the cam closest the buffing face of the coupler head, is greater than the angle between said axis and the camming surface of the cam farthest from said buffing face, when the lock is in a locked position.

9. The coupler of claim 8, wherein the lug has a generally rectangular cross-section and the longitudinal axis of the lug is parallel to the camming surfaces of the cam.

10. The coupler of claim 9, wherein the angle (B) between the longitudinal axis of the elongated slot of the pawl and the camming surface of the cam closest the buffing face of the coupler head, is greater than 45° and less than 90°.

11. A coupler having a shank extending from a chambered head with a buffing face that connects a pair of laterally spaced fixed jaws, and a locking mechanism which comprises:

(a) a spring biased lock disposed within the chambered head and movable generally longitudinally of the coupler shank between a locked position and a lockset position, the lock having an axially elongated slot therein;

(b) a locklifting lever for moving the lock between the locked and lockset positions, the lever having a pair of opposing ends;

(c) means mounting the lever on the coupler head for limited rotation about an axis which is normal to the longitudinal axis of the coupler shank;

(d) a handle at one of the opposing ends of the lever and disposed exteriorly of the coupler head for operating the lever;

(e) a lug and rocker arm disposed within the chambered head at the other of the opposing ends of the lever, the lug and arm extending in opposite directions from the plane of the lever, the arm being received in the slot of the lock and designed to move the lock axially against the biasing spring, when the handle of the lever is rotated in one direction to operate the lever;

(f) a pawl for engaging the lug and holding the lock in the lockset position, the pawl having a plate at one end thereof for receipt in an opening disposed in the buffing face of the coupler adjacent the lock, the pawl including a cam for slidably engaging the lug and interlocking coaction with the lug when the lock is moved by the lever to the lockset position, the cam being shaped to cause movement of the pawl at least upwardly in the direction of the lever handle as the cam lug slidably engage when the lock moves from lockset to a locked position; and (g) means mounting the pawl for limited movement in a direction which is generally normal to the axial direction in which the lock moves between the locked and lockset positions.

12. The coupler of claim 11, wherein the cam is V-shaped, has a pair of intersecting camming surfaces which converge in a direction away from the handle, and includes a surface angularly disposed to the axial direction in which the lock moves between the locked and lockset positions, the surface acting as a stop against which the lug rests when the lock is in a lockset position.

* * * * *